US011337472B2

(12) United States Patent
Isobe et al.

(10) Patent No.: US 11,337,472 B2
(45) Date of Patent: May 24, 2022

(54) GLOVE

(71) Applicant: SHOWA GLOVE CO., Himeji (JP)

(72) Inventors: Shogo Isobe, Hyogo (JP); Tatsuya Sakamoto, Hyogo (JP)

(73) Assignee: Showa Glove Co., Hyogo (JP)

( * ) Notice: Subject to any disclaimer, the term of this patent is extended or adjusted under 35 U.S.C. 154(b) by 996 days.

(21) Appl. No.: 15/828,821

(22) Filed: Dec. 1, 2017

(65) Prior Publication Data

US 2018/0249773 A1 Sep. 6, 2018

(30) Foreign Application Priority Data

Mar. 3, 2017 (JP) ..... JP2017-041052

(51) Int. Cl.
*A41D 19/00* (2006.01)
*A41D 19/015* (2006.01)

(52) U.S. Cl.
CPC ..... *A41D 19/0065* (2013.01); *A41D 19/0006* (2013.01); *A41D 19/01505* (2013.01); *A41D 19/01558* (2013.01)

(58) Field of Classification Search
CPC ..... A41D 27/13; A41D 31/125; A41D 31/02; A41B 1/08
See application file for complete search history.

(56) References Cited

U.S. PATENT DOCUMENTS 10,912,342 B2 * 2/2021 Isobe ..... C08K 3/22
10,954,364 B2 * 3/2021 Enomoto ..... B29C 41/003
2004/0231028 A1 * 11/2004 Triebes ..... A41D 19/0068 2/161.7
2018/0249773 A1 * 9/2018 Isobe ..... A41D 19/0065
2019/0118515 A1 * 4/2019 Constantinou ..... A43B 13/04
(Continued)

FOREIGN PATENT DOCUMENTS

JP 2013-203914 A 10/2013
JP 2015-129362 A 7/2015
(Continued)

OTHER PUBLICATIONS

Brown H. P. et al.: "Crosslinking Reactions of Carboxylic Elastomers", Rubber Chemistry and Technology, American Chemical Society, Rubber Division, US, vol. 36, No. 4, Jan. 1, 1963 91963-01-01), pp. 931-962, XP001109664, ISSN: 0035-9475.

*Primary Examiner* — Katherine M Moran
(74) *Attorney, Agent, or Firm* — Norris McLaughlin, P.A.

(57) ABSTRACT

A glove is provided that enables suppression of cracks in a coating layer containing nitrile butadiene rubber as a principal component. The glove comprises: a glove main body made of fibers for covering a wearer's hand; and a coating layer which comprises nitrile butadiene rubber as a principal component and coats at least a part of an outer face of a palm region of the glove main body, in which: the coating layer comprises zinc oxide and a cross-linked product of the nitrile butadiene rubber and polycarbodiimide; and a mass ratio of the polycarbodiimide to the nitrile butadiene rubber is no less than 0.002. The mass ratio of the polycarbodiimide to the nitrile butadiene rubber is preferably no greater than 0.09. The content of the zinc oxide with respect to 100 parts by mass of the nitrile butadiene rubber is preferably from 0.3 to 5 parts by mass.

1 Claim, 3 Drawing Sheets

(56) References Cited

U.S. PATENT DOCUMENTS

| | | | | |
|---|---|---|---|---|
| 2019/0150537 | A1* | 5/2019 | Isobe | C08K 5/29 |
| 2019/0161601 | A1* | 5/2019 | Enomoto | A41D 19/00 |
| 2019/0174848 | A1* | 6/2019 | Enomoto | A41D 19/04 |

FOREIGN PATENT DOCUMENTS

| | | | |
|---|---|---|---|
| JP | 2015-187227 | A | 10/2015 |
| WO | 2016/013666 | A1 | 1/2016 |

* cited by examiner

GLOVE

BACKGROUND OF THE INVENTION

The present invention relates to a glove.

DESCRIPTION OF THE RELATED ART

As a glove having an enhanced anti-slipping effect, a glove has been known comprising: a glove main body made of fibers for covering a wearer's hand; and a coating layer that coats an outer face of a palm region of the glove main body. In particular, as a glove suitable for tasks involving oil, a glove with a coating layer constituted with nitrile butadiene rubber as a principal component has been proposed (see Japanese Unexamined Patent Application, Publication No. 2015-129362).

Such a glove is produced through formation of the coating layer, for example by the following procedure. First, the glove main body is immersed in a coagulation agent and then in a latex material containing nitrile butadiene rubber latex. Subsequently, a coating film formed on an outer face of the glove main body by the immersion is dried to form a coating layer.

Since the latex material contains water in an amount of no less than 50% by mass, the undried coating film contains a large amount of moisture immediately after the immersion. As a result, the coating film is likely to contract during the drying, and thus cracks are likely to be generated in the coating layer of the glove to be produced. Such cracks deteriorate appearance and may therefrom lead to formation of a cleavage in the coating layer, resulting in reduced durability of the glove, as well as reduced oil resistance and chemical resistance of the glove due to penetration through the cleavage.

PRIOR ART DOCUMENTS

Patent Documents

Patent Document 1: Japanese Unexamined Patent Application Publication No. 2015-129362

SUMMARY OF THE INVENTION

Problems to be Solved by the Invention

The present invention has been made in view of the aforementioned situation, and an object of the invention is to provide a glove that enables inhibition of generation of cracks in a coating layer constituted with nitrile butadiene rubber as a principal component.

Means for Solving the Problems

The present inventors have found that generation of cracks is dramatically inhibited in a coating layer formed from a nitrile butadiene rubber latex material with polycarbodiimide and zinc oxide concurrently blended, and thus the present invention was accomplished. Although not necessarily clarified, the mechanism of the inhibition of the cracks is presumed to be as in the following. Since the positions of a polar group in nitrile butadiene rubber and a carbodiimide group in the polycarbodiimide are fixed and proximate to each other due to polarity of the zinc oxide, the polar group is more likely to react with the carbodiimide group in the polycarbodiimide, resulting in promotion of crosslinking. In other words, it is presumed that the contraction of the coating film during formation of the coating layer would fail to result in the generation of cracks due to such an effect of promoting the crosslinking.

According to an aspect of the invention made for solving the aforementioned problems, a glove comprises: a glove main body made of fibers for covering a wearer's hand; and a coating layer which comprises nitrile butadiene rubber as a principal component and coats at least a part of an outer face of a palm region of the glove main body, wherein: the coating layer comprises zinc oxide and a cross-linked product of the nitrile butadiene rubber and polycarbodiimide; and a mass ratio of the polycarbodiimide to the nitrile butadiene rubber is no less than 0.002.

In the glove of the aspect of the invention, the coating layer contains zinc oxide and the cross-linked product of the nitrile butadiene rubber and the polycarbodiimide, and the mass ratio of the polycarbodiimide to the nitrile butadiene rubber is no less than the aforementioned lower limit. Accordingly, cracks are less likely to be generated in the coating layer of the glove, due to the crosslinking of the nitrile butadiene rubber and the polycarbodiimide. Therefore, the glove is superior in appearance, and also superior in durability, oil resistance, and chemical resistance due to less likelihood of formation of a cleavage in the coating layer.

The mass ratio of the polycarbodiimide to the nitrile butadiene rubber is preferably no greater than 0.09. When the mass ratio of the polycarbodiimide is no greater than the upper limit, flexibility of the glove is improved.

The content of the zinc oxide with respect to 100 parts by mass of the nitrile butadiene rubber is preferably no less than 0.3 parts by mass and no greater than 5 parts by mass. When the content of the zinc oxide falls within the above range, the coating layer is enabled to have increased strength, while the flexibility of the glove is ensured.

The cross-linked product of the nitrile butadiene rubber and the polycarbodiimide preferably includes: a carboxyl group; a carbodiimide group; and a reaction-produced group from a carboxyl group and a carbodiimide group. Positions of the carboxyl group and the carbodiimide group are likely to be fixed and proximate to each other due to the zinc oxide. Accordingly, the reaction-produced group from the carboxyl group and the carbodiimide group is likely to be produced and therefore the crosslinking is readily promoted during production of the glove of the aspect of the invention. Further inhibition of the generation of cracks is thus enabled.

The molar ratio of a total of the carbodiimide group and the reaction-produced group to a total of the carboxyl group and the reaction-produced group is preferably no less than 0.008 and no greater than 1. When the molar ratio falls within the above range, further inhibition of the generation of cracks and increase in tensile strength of the glove are enabled, while the flexibility of the glove is ensured.

The term "principal component" as referred to herein means a component which is of the highest content, for example a component of which content is no less than 50% by mass.

Effects of the Invention

As explained in the foregoing, in the glove according to the aspect of the present invention, inhibition of the generation of cracks in the coating layer constituted with the nitrile butadiene rubber as a principal component is enabled. Therefore, the glove according to the aspect of the present invention is superior in appearance, and also superior in durability, oil resistance and chemical resistance due to less likelihood of formation of a cleavage in the coating layer.

DESCRIPTION OF THE PREFERRED EMBODIMENTS

Embodiments of the present invention will be described in detail hereafter, with appropriate reference to the drawings.

Figure 1:
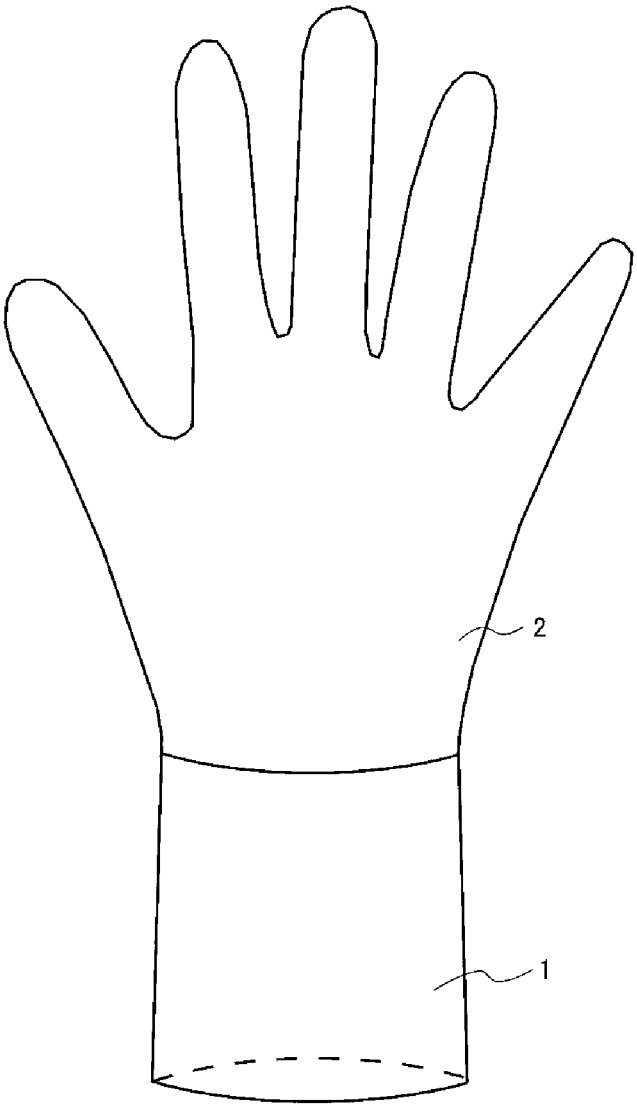
FIG. 1 is a schematic view of a glove according to an embodiment of the present invention taken from a palm side.

The glove illustrated in FIG. 1 is provided with: a glove main body 1 made of fibers for covering a wearer's hand; and a coating layer 2 which coats an outer face of a palm region of the glove main body 1.

Glove Main Body

The glove main body 1 is formed by knitting a yarn made from fibers into a glove shape. The glove main body 1 includes: a main body portion formed in a pouch-like shape to cover a main body of a wearer's hand; an extending portion extending from the main body portion to cover the wearer's fingers; and a cylindrical cuff portion extending from the main body portion in an opposite direction to the extending portion to cover the wearer's wrist. The extending portion includes a first finger portion, a second finger portion, a third finger portion, a fourth finger portion, and a fifth finger portion that cover the wearer's first finger (thumb), second finger (index finger), third finger (middle finger), fourth finger (ring finger), and fifth finger (pinky finger) respectively. The first to fifth finger portions are each formed in a cylindrical shape with a closed fingertip portion. In addition, the cuff portion has an opening through which the wearer's hand can be inserted.

The fibers constituting the glove main body 1 are not particularly limited, and natural fibers, synthetic fibers, inorganic fibers, and the like may be used. The natural fibers are exemplified by cotton, silk, wool, linen fibers, and the like. The synthetic fibers are exemplified by polyethylene fibers, polyester fibers, nylon fibers, aramid fibers, super high-strength polyethylene fibers, polyurethane fibers, polyimide fibers, rayon fibers, acrylic fibers, polyparaphenylene terephthalamide fibers, and the like. The inorganic fibers may be exemplified by stainless fibers, tungsten fibers, glass fibers, and the like.

The glove main body 1 is formed from a yarn made from the aforementioned fibers. The yarn is exemplified by a spun yarn, a filament yarn, a processed yarn such as a crimped yarn, and the like. The fibers used for the yarn may be of one type, or a mixture of two or more types. Examples of a yarn using a mixture of two types of fibers include: a spun yarn obtained by blending cotton and polyester short fibers; and a composite yarn in which stainless fibers are covered with nylon or the like.

The glove main body 1 may be formed by cutting out into a glove shape from a woven fabric, a knitted fabric or a nonwoven fabric formed from the aforementioned fibers and then sewing; however, the glove main body is preferably formed by seamlessly knitting with a seamless knitting machine. When the glove main body 1 is formed by knitting with the seamless knitting machine, the glove is superior in production cost effectiveness, flexibility, and wearing feel. In the case of knitting the glove main body 1 with the seamless knitting machine, the knitting gauge of the glove main body 1 is preferably no less than 10 and no greater than 26.

The lower limit of the average thickness of the glove main body 1 is preferably 0.1 mm, and more preferably 0.2 mm. Meanwhile, the upper limit of the average thickness of the glove main body 1 is preferably 1.3 mm, and more preferably 1.0 mm. When the average thickness of the glove main body 1 is less than the lower limit, strength of the glove may be insufficient, leading to inferior durability. To the contrary, when the average thickness of the glove main body 1 is greater than the upper limit, the flexibility of the glove may be inferior due to the increased thickness, leading to inferior workability during use of the glove. It is to be noted that the average thickness is an average of values obtained by measuring at arbitrary five points with a constant pressure thickness gauge conforming to JIS-L1086/L1096 (e.g., PG-15 available from TECLOCK Corporation).

It is to be noted that the glove main body 1 may be subjected to various types of treatment with e.g., a softening agent, a water- and oil-repellent agent, an antimicrobial etc., and may be also provided with an ultraviolet ray protection function through application, impregnation or the like of an ultraviolet ray absorbing agent, etc. Alternatively, the fibers constituting the glove main body 1 may incorporate a chemical agent for imparting any of these functions.

Coating Layer

The coating layer 2 is constituted with the nitrile butadiene rubber as a principal component. The coating layer 2 further contains zinc oxide, and a cross-linked product of the nitrile butadiene rubber and polycarbodiimide.

Figure 2:
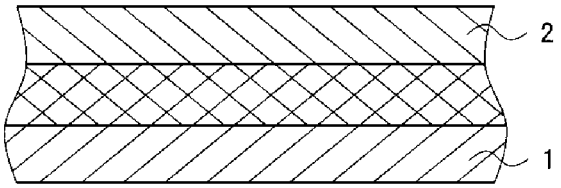
FIG. 2 is a partial cross-sectional view of the glove of FIG. 1.
Figure 3:
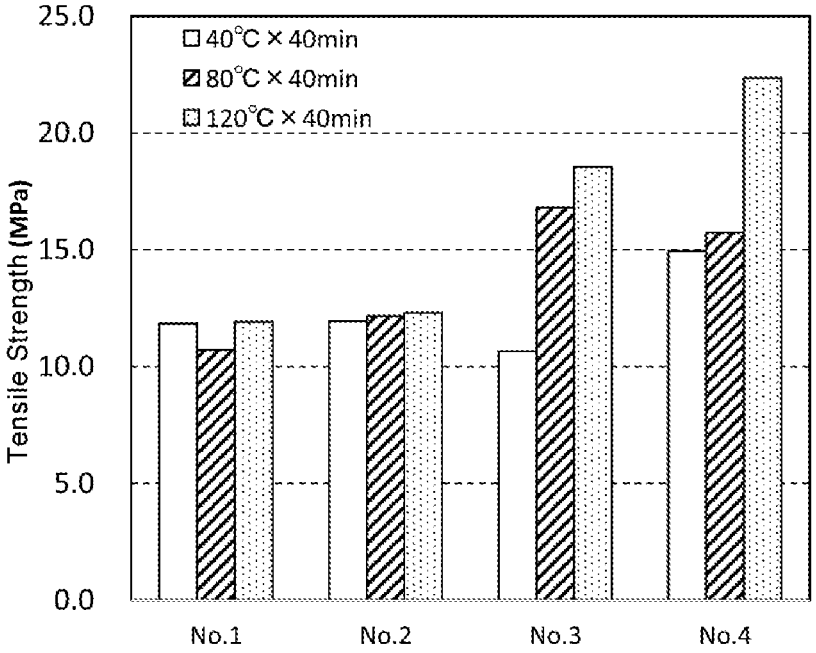
FIG. 3 is a graph indicating measurement results of tensile strength of Examples.

It is preferred that the coating layer 2 has penetrated into the glove main body 1 as illustrated in FIG. 2. Meanwhile, it is preferred that the coating layer 2 has not reached an inner face of the glove main body 1. Due to the coating layer 2 having penetrated into the glove main body 1 and not having reached the inner face of the glove main body 1, inhibition of separation of the coating layer 2 from the glove main body 1 is enabled while deterioration in texture of the inner face of the glove is inhibited.

The thickness of the coating layer 2 is determined in light of durability and flexibility. The lower limit of the average thickness of the coating layer 2 is preferably 0.15 mm, more preferably 0.20 mm, still more preferably 0.25 mm, and particularly preferably 0.30 mm. Meanwhile, the upper limit of the average thickness of the coating layer 2 is preferably 1.50 mm, more preferably 1.20 mm, still more preferably 1.00 mm, and particularly preferably 0.70 mm. The thickness may be either a thickness of a single layered coating layer, or a total thickness of multi-layered coating layer. The term "average thickness of the coating layer 2" as referred to means an arithmetic average of values obtained by: in a central portion of the palm region of the glove, observing with a digital microscope (for example, 100-fold magnification with VHX-900 available from KEYENCE CORPORATION) a cross section of the coating layer 2 taken at about 45° with respect to a longitudinal direction of fingers; and in a region of 20 mm in width, measuring a distance between an innermost face and an outer face of the coating layer 2 at 11 points at 2-mm intervals.

Nitrile Butadiene Rubber

The nitrile butadiene rubber is prepared by copolymerizing acrylonitrile and butadiene as monomers.

The lower limit of the amount of the acrylonitrile blended with respect to 100 parts by mass of the nitrile butadiene rubber is preferably 20 parts by mass, and more preferably 25 parts by mass. Meanwhile, the upper limit of the amount of the acrylonitrile blended is preferably 40 parts by mass, more preferably 35 parts by mass, and still more preferably 30 parts by mass. When the amount of the acrylonitrile blended is less than the lower limit, oil resistance and durability of the glove may be inferior. To the contrary, when the amount of the acrylonitrile blended is greater than the upper limit, the flexibility of the glove may be inferior.

The lower limit of the amount of the butadiene blended with respect to 100 parts by mass of the nitrile butadiene rubber is preferably 55 parts by mass, more preferably 57 parts by mass, and still more preferably 62 parts by mass. Meanwhile, the upper limit of the amount of the butadiene blended is preferably 78 parts by mass, more preferably 72 parts by mass, and still more preferably 70 parts by mass. When the amount of the butadiene blended is less than the lower limit, the flexibility of the glove may be inferior. To the contrary, when the amount of the butadiene blended is greater than the upper limit, oil resistance and durability of the glove may be inferior.

In preparing the nitrile butadiene rubber, a well-known monomer may be also copolymerized, within a range not leading to impairment of the strength and flexibility of the glove. The well-known monomer is exemplified by a monomer having a polar group such as a carboxyl group, a sulfonic acid group, an acid anhydride group and an amide group. Examples of the monomer having a carboxyl group include: ethylenic unsaturated monocarboxylic acid monomers such as acrylic acid, methacrylic acid, crotonic acid and cinnamic acid; and the like. Examples of the monomer having a sulfonic acid group include: ethylenic unsaturated sulfonic acid monomers such as styrene sulfonic acid; and the like. Examples of the monomer having an acid anhydride group include: ethylenic unsaturated acid anhydride monomers such as maleic anhydride and citraconic anhydride; and the like. Examples of the monomer having an amide group include: ethylenic unsaturated carboxylic acid amide monomers such as (meth)acrylamide, N,N-dimethylacrylamide and N-methylolacrylamide; and the like. After the copolymerization, these polar groups are capable of serving to improve stability of latex, which is a material for the coating layer 2. Specifically, in the latex material, a part of these are each paired with a monovalent cation such as a potassium ion, a sodium ion and an ammonium ion, to stabilize nitrile-butadiene rubber latex particles in an aqueous solvent. Furthermore, a part or all of the aforementioned polar groups (including ionized products) react with the polycarbodiimide and/or the zinc oxide contained in the coating layer 2 to form a covalent bond with the carbodiimide group and/or a metallic bond with a zinc ion. This enables promotion of the crosslinking in the coating layer 2. In particular, methacrylic acid and acrylic acid are preferably used as the monomer in light of stability and/or physical properties.

The lower limit of the amount of the methacrylic acid or the acrylic acid blended with respect to 100 parts by mass of the nitrile butadiene rubber is preferably 2 parts by mass, and more preferably 3 parts by mass. Meanwhile, the upper limit of the amount of the methacrylic acid or the acrylic acid blended is preferably 10 parts by mass, and more preferably 8 parts by mass. When the amount of the methacrylic acid or the acrylic acid blended is less than the lower limit, an effect of improving stability of the latex material may be insufficient, and/or an effect of promoting crosslinking in the coating layer 2 may be insufficient. To the contrary, when the amount of the methacrylic acid or the acrylic acid blended is greater than the upper limit, the coating layer 2 may be likely to contract during drying to generate cracks, and/or the flexibility of the glove may be inferior.

In addition, the nitrile butadiene rubber may contain an emulsifying agent, a pH adjusting agent, a crosslinking agent, a vulcanizing agent, a vulcanization accelerator, a thickening agent, a heat-sensitive agent, an antioxidant, a surfactant, a plasticizer, and the like, which may be typically blended into nitrile butadiene rubber. Of these, in light of improvement of the film formability, strength and solvent resistance of the coating layer 2, the vulcanizing agent or the vulcanization accelerator is preferably contained.

The vulcanizing agent is exemplified by powder sulfur, flowers of sulfur, precipitated sulfur, colloidal sulfur, surface-treated sulfur, insoluble sulfur, and the like. These vulcanizing agents may be used alone or in combination of two or more types. Of these, colloidal sulfur is preferred.

The amount of the vulcanizing agent blended with respect to 100 parts by mass of the nitrile butadiene rubber is preferably no less than 0.1 parts by mass and no greater than 3.0 parts by mass. When the amount of the vulcanizing agent blended is less than the lower limit, an effect of improving strength may be insufficient. To the contrary, when the amount of the vulcanizing agent blended is greater than the upper limit, the glove may be stiff in texture.

The vulcanization accelerator is exemplified by: dithiocarbamic acid-based vulcanization accelerators such as zinc dimethyldithiocarbamate, zinc diethyldithiocarbamate and zinc dibutyldithiocarbamate; thiazole-based vulcanization accelerators such as zinc-2-mercaptobenzothiazole; thiuram-based vulcanization accelerators; thiourea-based vulcanization accelerators; guanidine-based vulcanization accelerators; and the like. These vulcanization accelerators may be used alone or in combination of two or more types. Of these, the dithiocarbamic acid-based vulcanization accelerators are preferred.

The amount of the vulcanization accelerator blended with respect to 100 parts by mass of the nitrile butadiene rubber is preferably no less than 0.5 parts by mass and no greater than 5.0 parts by mass. When the amount of the vulcanization accelerator blended is less than the lower limit, an effect of accelerating vulcanization may be insufficient. To the contrary, when the amount of the vulcanization accelerator blended is greater than the upper limit, the glove may be firm in texture, and initial vulcanization is accelerated to cause scorching.

Polycarbodiimide

Polycarbodiimide is a compound having a plurality of carbodiimide groups in a single molecule. As the polycarbodiimide, a polymer synthesized through a condensation reaction of an organic diisocyanate compound accompanied by decarboxylation may be employed. The organic diisocyanate compound is exemplified by an aromatic diisocyanate compound, an aliphatic diisocyanate compound, an alicyclic diisocyanate compound, and a mixture thereof. Specifically, examples of the organic diisocyanate compound include toluene-2,4-diisocyanate, toluene-2,6-diisocyanate, a mixture of toluene-2,4-diisocyanate and toluene-2,6-diisocyanate, diphenylmethane-4,4-diisocyanate, 1,4-phenylenediisocyanate, dicyclohexyl-methane-4,4'-diisocyanate, 3-isocyanatomethyl-3,5,5-trimethylcyclohexyl isocyanate, 1,6-hexyl diisocyanate, 1,4-cyclohexyl diisocyanate, norbornyl diisocyanate, and the like. Of these, dicyclohexyl-methane-4,4'-diisocyanate and 3-isocyanatomethyl-3,5,5-trimethylcyclohexyl isocyanate are preferred.

Specific examples of the polycarbodiimide include V-02 (590), V-02-L2 (385), SV-02 (430), V-04 (335), V-10 (410), SW-12G (465), E-02 (445), E-03A (365) and E-05 (310) available from Nisshinbo Chemical Inc., and the like. It is to be noted that the numerical values in parentheses each indicate carbodiimide equivalent. Alternatively, XR-5508, XR-5577, XR-5580 and XR-13-554 available from Stahl Japan Limited, and the like may also be used. Of these, E-02, E-03A, E-05, and XR-5508 are preferred from the perspective that these are aqueous solvent-based and provide superior pot life performance of blended materials.

A carbodiimide group reacts with the polar group in the nitrile butadiene rubber to form a cross-linked product. As a result, during the formation of the coating layer 2, the film formability after drying is improved and consequently inhibition of the generation of cracks is enabled. In addition, the coating layer 2 is formed by immersing the glove main body 1 in the latex material containing the nitrile butadiene rubber as described later, the polycarbodiimide and the zinc oxide, and it is presumed that the crosslinking reaction takes place even in the undried coating film immediately after the immersion to consequently enhance an effect of improving the film formability provided by the zinc oxide.

The lower limit of the carbodiimide equivalent of the polycarbodiimide is preferably 200, and more preferably 250. Meanwhile, the upper limit of the carbodiimide equivalent of the polycarbodiimide is preferably 1,000, and more preferably 650. When the carbodiimide equivalent of the polycarbodiimide is less than the lower limit, the flexibility of the glove may be inferior. To the contrary, when the carbodiimide equivalent of the polycarbodiimide is greater than the upper limit, the effect of promoting crosslinking provided by the carbodiimide group may be insufficient. The term "carbodiimide equivalent" as referred to herein means a mass (g) of a carbodiimide compound necessary for providing 1 mol of the carbodiimide group, i.e., a numerical value obtained by dividing a molecular weight of the carbodiimide compound by the number of carbodiimide groups contained in the carbodiimide compound.

The lower limit of the mass ratio of the polycarbodiimide to the nitrile butadiene rubber is preferably 0.002, and more preferably 0.004. Meanwhile, the upper limit of the mass ratio of the polycarbodiimide is preferably 0.09, and more preferably 0.06. When the mass ratio of the polycarbodiimide is less than the lower limit, the effect of inhibiting the generation of cracks in the coating layer 2 may be insufficient and/or the tensile strength of the coating layer 2 may be inferior. To the contrary, when the mass ratio of the polycarbodiimide is greater than the upper limit, the flexibility of the glove may be inferior.

The cross-linked product of the nitrile butadiene rubber and the polycarbodiimide preferably includes: a carboxyl group; a carbodiimide group; and a reaction-produced group from a carboxyl group and a carbodiimide group. Positions of reactive groups such as the carboxyl group and the carbodiimide group are likely to be fixed and proximate to each other due to the zinc oxide. Accordingly, production of the reaction-produced group from the carboxyl group and the carbodiimide group is facilitated and thus crosslinking is likely to be promoted during production of the glove. Consequently, further inhibition of the generation of cracks is enabled.

In the case in which the cross-linked product of the nitrile butadiene rubber and the polycarbodiimide comprises the carboxyl group and the reaction-produced group from the carboxyl group and the carbodiimide group, the lower limit of a molar ratio of a total of the carbodiimide group and the reaction-produced group to a total of the carboxyl group and the reaction-produced group is preferably 0.008, more preferably 0.01, still more preferably 0.015, and particularly preferably 0.02. Meanwhile, the upper limit of the molar ratio is preferably 1, more preferably 0.5, and still more preferably 0.3. When the molar ratio is less than the lower limit, the effect of inhibiting the generation of cracks in the coating layer 2 may be insufficient, and/or the tensile strength of the coating layer 2 may be inferior. To the contrary, when the molar ratio is greater than the upper limit, the flexibility of the glove may be inferior.

Zinc Oxide

Zinc oxide interacts with the polar group in the nitrile butadiene rubber to improve the film formability of the coating layer 2 after the immersion in the latex material. However, the effect of improving the film formability provided by the zinc oxide alone is relatively small, and consequently, during the drying after the immersion to form the coating layer 2, the coating layer 2 may not resist tension generated by contraction thereof with a decrease in volume due to vaporization of moisture, whereby the cracks may be generated. In this respect, the glove of the embodiment of the present invention enables enhancement of the effect of improving film formation due to the polycarbodiimide and the zinc oxide contained in the coating layer 2, and thus cracks are less likely to be generated in the coating layer 2.

The lower limit of the content of the zinc oxide with respect to 100 parts by mass of the nitrile butadiene rubber is preferably 0.3 parts by mass, and more preferably 1 part by mass. Meanwhile, the upper limit of the content of the zinc oxide is preferably 5 parts by mass, more preferably 4 parts by mass, and still more preferably 3.5 parts by mass. When the content of the zinc oxide is less than the lower limit, the strength of the coating layer 2 may be insufficient. To the contrary, when the content of the zinc oxide is greater than the upper limit, the flexibility of the glove may be inferior; and/or the excessive amount of the zinc oxide may result in reduced strength of the coating layer 2 and instability of the latex material.

In the case in which the nitrile butadiene rubber includes the carboxyl group, the lower limit of the molar ratio of the zinc oxide to the carboxyl group is preferably 0.1, and more preferably 0.2. Meanwhile, the upper limit of the molar ratio of the zinc oxide to the carboxyl group is not particularly limited, but preferably 1, and more preferably 0.5. When the molar ratio of the zinc oxide is less than the lower limit, the effect of inhibiting the generation of cracks in the coating layer 2 may be insufficient. To the contrary, when the molar ratio of the zinc oxide is greater than the upper limit, the excessive amount of the zinc oxide may deteriorate the coating layer 2.

The lower limit of the molar ratio of the zinc oxide to the carbodiimide group is preferably 1, and more preferably 5. Meanwhile, the upper limit of the molar ratio of the zinc oxide to the carbodiimide group is preferably 50, more preferably 40, and still more preferably 35. When the molar ratio of the zinc oxide to the carbodiimide group is less than the lower limit, the relative amount of the zinc oxide is so small that the effect of inhibiting the generation of cracks in the coating layer 2 may be insufficient. To the contrary, when the molar ratio of the zinc oxide to the carbodiimide group is greater than the upper limit, the relative amount of the carbodiimide group is so small that the effect of inhibiting the generation of cracks in the coating layer 2 may be insufficient.

Production Method of Glove

The glove may be produced through formation of the coating layer 2 on the outer face of the glove main body 1 by immersion processing. Specifically, the glove may be produced by, for example, a production method comprising: immersing in a coagulation agent solution; immersing in the latex material; and drying. Each step will be described below.

Immersing in Coagulation Agent Solution

In the immersing in the coagulation agent solution, the glove main body 1 formed is put onto a hand glove mold for glove production, immersed in and withdrawn from the coagulation agent solution, and then a solvent is volatilized.

As the coagulation agent solution, a well-known solution may be used such as a methanol solution and an aqueous solution each containing a polyvalent metal salt and/or an organic acid. In particular, the polyvalent metal salt is preferably contained. Due to the polyvalent metal salt being contained in the coagulation agent solution, excessive penetration of the latex material into the glove main body 1 is likely to be inhibited.

The polyvalent metal salt is exemplified by barium chloride, calcium chloride, magnesium chloride, zinc chloride, aluminum chloride, barium nitrate, calcium nitrate, zinc nitrate, barium acetate, calcium acetate, zinc acetate, calcium sulfate, magnesium sulfate, aluminum sulfate, and the like. These polyvalent metal salts may be used alone or in combination of two or more types.

The lower limit of the content of the polyvalent metal salt in the coagulation agent solution is preferably 0.3% by mass, and more preferably 0.8% by mass. Meanwhile, the upper limit of the content of the polyvalent metal salt is not particularly limited as long as inhibition of separation of the coating layer 2 from the glove main body 1 is enabled, but is preferably 5% by mass, and more preferably 3% by mass. When the content of the polyvalent metal salt is less than the lower limit, during the immersing in the latex material (described later), reaching of the nitrile butadiene rubber to the inner face of the glove main body 1 may not be sufficiently inhibited, leading to poor texture of the inner face of the glove. To the contrary, when the content of the polyvalent metal salt is greater than the upper limit, cracks may be more likely to be generated in the coating layer 2 due to rapid aggregation of a coating film formed after the immersing in the latex material, and/or the coating layer 2 may be more likely to separate from the glove main body 1 due to insufficient penetration of the latex material into the glove main body 1.

The organic acid is exemplified by acetic acid, citric acid, and the like. The content of the organic acid in the coagulation agent solution is preferably no less than 5% by mass and no greater than 35% by mass. The organic acid may be used alone, but is preferably used in a mixture with the polyvalent metal salt. By using the organic acid in a mixture with the polyvalent metal salt, inhibition of thinning of the coating layer 2 is enabled. In addition, the film forming performance of the coagulation agent solution can be controlled more easily than in the case of using each of the organic acid and the polyvalent metal salt individually.

The temperature of the hand glove mold upon immersing the hand glove mold in the coagulation agent solution is preferably no less than 40° C. and no greater than 70° C.

The temperature for the volatilization of the solvent after immersion in and withdrawal from the coagulation agent solution is preferably no less than 25° C. and no greater than 70° C. The duration of the volatilization of the solvent is preferably no less than 10 sec and no greater than 600 sec. The volatilization of the solvent enables control of penetration of the latex material in the subsequent step. As a result, prevention of separation of the coating layer 2 thus formed is enabled, while deterioration in texture of the inner face of the glove due to reaching of the nitrile butadiene rubber to the inner face of the glove main body 1 is inhibited. In light of control of penetration of the latex material, the duration of the volatilization of the solvent is more preferably no less than 10 sec and no greater than 60 sec in the case of using methanol as the solvent; and no less than 30 sec and no greater than 600 sec in the case of using water as the solvent.

Immersing in Latex Material

In the immersing in the latex material, the glove main body 1 put onto the hand glove mold obtained after the immersing in the coagulation agent solution is immersed in and withdrawn from the latex material.

The latex material is obtained by blending the polycarbodiimide and the zinc oxide with the nitrile butadiene rubber latex. The amounts of the polycarbodiimide and the zinc oxide blended are adjusted such that, after the formation of the coating layer, the contents of the zinc oxide and the cross-linked product of the nitrile butadiene rubber and the polycarbodiimide are as desired. In addition, additives such as a vulcanizing agent, a vulcanization accelerator and a surfactant may be added as needed.

Drying

In the drying, the glove main body 1 put onto the hand glove mold obtained after the immersing in the latex material is dried. Specifically, moisture in the coating film formed by the immersing in the latex material is vaporized and then the crosslinking reaction is promoted, to thereby form the coating layer 2. The drying may be carried out by, for example, using a well-known oven.

The drying may be carried out in a high temperature environment immediately after the immersing of the glove main body in the latex material, but is preferably carried out in the high temperature environment after that the glove main body has been held at room temperature (no less than 20° C. and no greater than 40° C.) for a predetermined time period. The present inventors have obtained a knowledge that providing such a time period for holding the glove main body at room temperature enhances the effect of inhibiting the generation of cracks.

The time period for holding the hand glove mold at room temperature is preferably no less than 20 sec and no greater than 200 sec. When the time period is less than the lower limit, the drying is likely to be non-homogeneous and therefore the cracks may be likely to be generated in the coating layer 2. To the contrary, when the time period is greater than the upper limit, the production efficiency may be inferior, and/or the undried coating film may sag.

The temperature of the high temperature environment for vaporizing moisture is preferably no less than 50° C. and no greater than 100° C. When the temperature is less than the lower limit, the undried coating film may sag, leading to unevenness of the coating layer 2. To the contrary, when the temperature is greater than the upper limit, the drying is likely to be non-homogeneous due to rapid drying, and consequently strong tension is likely to be applied to a part of the coating film. As a result, the coating film is likely to contract, leading to generation of cracks in the coating layer 2. A time period for vaporizing moisture after the raising of temperature is preferably no less than 10 min and no greater than 30 min, in light of the production efficiency.

The temperature upon the promotion of the crosslinking reaction is preferably no less than 100° C. and no greater than 150° C. When the temperature upon the promotion of the crosslinking reaction is less than the lower limit, the crosslinking reaction may not be sufficiently promoted. To the contrary, when the temperature upon the promotion of the crosslinking reaction is greater than the upper limit, the crosslinking reaction may be non-homogeneous, and the glove main body 1 and/or the coating layer 2 may deteriorate due to heat.

After the vaporization of moisture and the promotion of the crosslinking reaction, the glove main body 1 with the coating layer 2 being formed thereon is removed from the hand glove mold, to thereby obtain the glove.

In the production method of a glove, since the polycarbodiimide and the zinc oxide are blended into the latex material, appropriate crosslinking is likely to occur during the immersing in the latex material the hand glove mold having been immersed in the coagulation agent and during vaporization of moisture, and consequently the cracks are less likely to be generated in the glove obtained.

Incidentally, the coagulation agent and the surfactant may bloom or bleed from the coating film. In such a case, the coagulation agent and the surfactant may be removed by: immersing in a water bath the glove on the hand glove mold after the vaporization of moisture; laundering the glove removed from the hand glove mold; or the like. The removal of the coagulation agent and the surfactant may take place after the vaporization of moisture in the drying, or after the crosslinking reaction.

Advantages

In the glove of the present invention, since the coating layer 2 contains the zinc oxide and a crosslinked product of the nitrile butadiene rubber and the polycarbodiimide, and the mass ratio of the polycarbodiimide to the nitrile butadiene rubber being no less than 0.002, the cracks are less likely to be generated in the coating layer 2 due to the crosslinking between the nitrile butadiene rubber and the polycarbodiimide. Therefore, the glove is superior in appearance, and also superior in durability, oil resistance and chemical resistance due to less likelihood of formation of a cleavage in the coating layer 2.

Other Embodiments

The present invention is not limited to the above-described embodiment, and can also be carried out in modes modified and improved in various ways.

In the aforementioned embodiment, the coating layer covers the palm region of the glove main body; however, the coating layer may also cover the dorsal region of the glove main body. When the coating layer is provided also in the dorsal region, a protection function in the dorsal region of the glove is enabled to be enhanced.

Furthermore, the coating layer covering the entire palm region is not an essential constituent feature, and the coating layer may cover a part of the palm region.

The coating layer may have irregularities formed thereon. When such irregularities are formed, the anti-slipping effect of the glove is enhanced. A geometry of protruding parts constituting the irregularities is exemplified by a plurality of substantially hexagonal protruding parts arranged in one direction at regular intervals (honeycomb pattern), and the like.

In addition, the coating layer may be a foamed layer. When the coating layer is configured as a foamed layer, the anti-slipping effect and breathability of the glove are enhanced. A process of forming the foamed layer is exemplified by: applying the latex material being mechanically foamed; heating the latex material containing a chemical foaming agent to foam; and the like.

EXAMPLES

The present invention is described further in detail hereinafter with reference to Examples and Comparative Examples; however, the present invention is not limited to the following Examples.

Example 1

A seamless knitted glove was formed from 280 denier (d) wooly nylon (two-fold yarn of 70d×2), with a 13-gauge glove knitting machine ("N-SFG" available from Shima Seiki Mfg., Ltd.). In addition, a coagulation agent solution was prepared such that a calcium nitrate concentration was as specified in Table 1, and a latex material constituted with nitrile butadiene rubber (NBR) latex ("Nipol LX550L" available from Zeon Corporation) with polycarbodiimide ("CARBODILITE E-02" available from Nisshinbo Chemical Inc., carbodiimide equivalent: 445) and zinc oxide ("Zinc Oxide Type II" available from SEIDO CHEMICAL INDUSTRY CO., LTD.) blended thereinto as a principal component was prepared such that a solid content was as specified in Table 1. It is to be noted that the latex material was prepared through dilution with ion exchanged water such that a solid content was 36%.

The glove main body thus formed was put onto a hand glove mold at 55° C., the glove main body on the hand glove mold was immersed in and withdrawn from the coagulation agent solution, and then a part of a solvent was volatilized. Next, the glove main body on the hand glove mold was immersed in and withdrawn from the latex material. Thereafter, moisture in a coating film thus formed was vaporized at 70° C. for 30 min, and crosslinking was promoted at 120° C. for 30 min, to thereby obtain a glove of Example 1. It is to be noted that the average thickness of the coating layer of the glove of Example 1 was measured to be 0.315 mm. The term "average thickness of the coating layer" as referred to means an arithmetic average of values obtained by: in a central portion of the palm region of the glove, observing with a digital microscope (for example, 100-fold magnification with VHX-900 available from KEYENCE CORPORATION) a cross section of the coating layer taken at about 45° with respect to a longitudinal direction of fingers; and in a region of 20 mm in width, measuring a distance between an innermost face and an outer face of the coating layer at 11 points at 2-mm intervals.

Examples 2 to 12 and Comparative Examples 1 and 2

Gloves of Examples 2 to 12 and Comparative Examples 1 and 2 were obtained in a similar manner to the glove of Example 1, except that a coagulation agent solution prepared such that a calcium nitrate concentration was as specified in Table 1, and a latex material containing polycarbodiimide and zinc oxide prepared such that a solid content was as specified in Table 1, were used. It is to be noted that the latex material was prepared through dilution with ion exchanged water such that a solid content was 36% as with Example 1. The average thickness of the coating layer of the glove of Example 2 was measured to be 0.364 mm.

Visual Evaluation

Stability of the latex material; a state of the coating film after the vaporizing moisture and the promoting crosslinking; and penetration and separation of the coating layer into and from the glove main body, were visually evaluated. Evaluation criteria for each item are shown below. The evaluation results are shown in Table 1.

Evaluation Criteria for Stability of Material

A: No aggregate being generated in the material having been stored at 35° C. for one week, even after stirring with such intensity that a liquid surface does not undulate B: No aggregate being generated in the material having been stored at rest at 20° C. for one week; however, minute aggregates being generated in the material having been stored at 35° C. for one week, after stirring with such intensity that a liquid surface not undulated C: Aggregates being generated in the material having been stored at rest at 20° C. for one week D: Aggregates being generated during blending of the latex material Evaluation Criteria for State of Coating Film after Vaporization of Moisture A: Almost no crack being generated B: Negligible number of cracks being generated C: Cracks being generated, but practical use not being hindered D: Extremely large number of cracks being generated and practical use being hindered It is to be noted that these criteria are based on an increase in the number of cracks compared to a state before the vaporization of moisture.

Evaluation Criteria for State of Coating Film after Promotion of Crosslinking

A: Cracks being scarcely increased

B: Cracks being slightly increased, but substantially no increase being observed C: Cracks being increased D: Cracks being significantly increased and practical use being hindered It is to be noted that these criteria are based on an increase in the number of cracks compared to a state after the vaporization of moisture.

Evaluation Criteria for Penetration

A: Coating layer having not reached inner face of glove main body

D: Coating layer having reached inner face of glove main body

Evaluation Criteria for Separation

A: Almost no separation of coating layer being observed

B: Slight separation being partially observed upon exerting strong pull on coating layer, but separation not being widen and practical use not being hindered C: Separation being partially observed upon exerting strong pull on coating layer and separation widens slightly, but practical use not being hindered D: Large separation being observed even without pull on coating layer, and practical use being hindered Evaluation Criteria for Flexibility A: Glove being superior in flexibility B: Glove being relatively superior in flexibility and practical use not being hindered C: Glove being somewhat poor in flexibility and practical use being hindered D: Glove being poor in flexibility

TABLE 1

| | | Example 1 | Example 2 | Example 3 | Example 4 | Example 5 | Example 6 | Example 7 |
|---|---|---|---|---|---|---|---|---|
| Solid content rate (Parts by mass) | NBR | 100 | 100 | 100 | 100 | 100 | 100 | 100 |
| | Zinc oxide | 2.5 | 2.5 | 2.5 | 2.5 | 2.5 | 2.5 | 2.5 |
| | Polycarbodiimide | 0.3 | 0.5 | 2 | 5 | 7 | 10 | 2 |
| Mass ratio of polycarbodiimide to NBR | | 0.003 | 0.005 | 0.02 | 0.05 | 0.07 | 0.1 | 0.02 |
| Coagulation agent | Calcium nitrate (% by mass) | 1 | 1 | 1 | 1 | 1 | 1 | 0.2 |
| Stability of material | | A | A | A | A | A | A | A |
| State of coating film | After vaporization of moisture | B | A | A | A | A | A | A |
| | After promotion of crosslinking | B | A | A | A | A | A | A |
| State of glove | Flexibility | A | A | A | A | B | C | B |
| | Penetration | A | A | A | A | A | A | D |
| | Separation | A | A | A | A | A | A | A |

| | | Example 8 | Example 9 | Example 10 | Example 11 | Example 12 | Comparative Example 1 | Comparative Example 2 |
|---|---|---|---|---|---|---|---|---|
| Solid content rate (Parts by mass) | NBR | 100 | 100 | 100 | 100 | 100 | 100 | 100 |
| | Zinc oxide | 2.5 | 0.3 | 1 | 3.5 | 5 | 0 | 2.5 |
| | Polycarbodiimide | 2 | 2 | 2 | 2 | 2 | 10 | 0.1 |
| Mass ratio of polycarbodiimide to NBR | | 0.02 | 0.02 | 0.02 | 0.02 | 0.02 | 0.1 | 0.001 |
| Coagulation agent | Calcium nitrate (% by mass) | 6 | 1 | 1 | 1 | 1 | 1 | 1 |
| Stability of material | | A | A | A | A | C | A | A |
| State of coating film | After vaporization of moisture | A | C | A | A | B | D | C |
| | After promotion of crosslinking | A | B | A | A | A | C | D |
| State of glove | Flexibility | A | A | A | A | C | C | A |
| | Penetration | A | B | A | A | A | A | A |
| | Separation | C | A | A | A | A | A | A |

The results shown in Table 1 indicate that the gloves of Examples 1 to 12 each having the coating layer containing the zinc oxide and the cross-linked product of the nitrile butadiene rubber and the polycarbodiimide, in which the mass ratio of the polycarbodiimide to the nitrile butadiene rubber was no less than 0.002, had a small number of cracks both after the vaporization of moisture and after the promotion of crosslinking. Whereas, in the glove of Comparative Example 1 having a coating layer containing no zinc oxide, cracks were generated during the vaporization of moisture, and in the glove of Comparative Example 2 in which the mass ratio of the polycarbodiimide is less than 0.002, cracks were generated during the promotion of crosslinking. This shows that, in the coating layer containing the zinc oxide and the cross-linked product of the nitrile butadiene rubber and the polycarbodiimide, in which the mass ratio of the polycarbodiimide to the nitrile butadiene rubber is no less than 0.002, inhibition of the generation of cracks is enabled.

In addition, comparison among Examples 1 to 6 having different mass ratios of the polycarbodiimide shows that Example 6 having the mass ratio of the polycarbodiimide being greater than 0.09 was inferior in flexibility of the glove. Thus, it is proven that, when the mass ratio of the polycarbodiimide is no greater than 0.09, the flexibility of the glove is enabled to be ensured.

Furthermore, comparison among Examples 3 and 9 to 12 having different zinc oxide contents shows that, although practical use was not hindered, cracks were observed in Example 9 having the zinc oxide content being 0.3 parts by mass, and inferior stability of the latex material and inferior flexibility of the glove were observed in Example 12 having the zinc oxide content being 5 parts by mass. Thus, it is proven that, when the zinc oxide content is no less than 0.3 parts by mass and no greater than 5 parts by mass, inhibition of the generation of cracks is enabled while the stability of the latex material and the flexibility of the glove are ensured.

Moreover, comparison among Examples 3, 7 and 8 having different contents of calcium nitrate, which is a polyvalent metal salt, shows that in the glove of Example 7 having the calcium nitrate content being less than 0.3% by mass, reaching of the coating layer to the inner face of the glove was unable to be inhibited. Whereas, in the glove of Example 8 having the calcium nitrate content being greater than 5% by mass, the coating layer was likely to separate from the glove main body. Thus, it is proven that, when the content of calcium nitrate, which is a polyvalent metal salt, is no less than 0.3% by mass and no greater than 5% by mass, inhibition of reaching of the coating layer to the inner face of the glove is enabled while separation of the coating layer is inhibited.

Evaluation of Cracks in Coating Layer

In order to confirm that inhibition of the generation of cracks and improvement of strength are enabled when the coating layer contains the zinc oxide and the cross-linked product of the nitrile butadiene rubber and the polycarbodiimide, a film of the same composition as the coating layer was formed on a surface of an unglazed earthenware rod and strength of the coating layer alone was evaluated.

No. 1

Three unglazed earthenware rods were provided. The three rods were immersed in and withdrawn from a coagulation agent solution, which is a methanol solution containing 30% by mass of calcium nitrate, and then heated at 60° C. for 1 min to volatilize the solvent. Next, the three rods were immersed in and withdrawn from the latex material shown in Table 2 constituted with nitrile butadiene rubber (NBR) latex as a principal component, moisture was vaporized at 40° C. for 40 min, and then a crosslinking reaction was promoted at 40° C., 80° C., and 120° C., respectively, for 40 min. Three films of No. 1 were thus obtained with different crosslinking reaction temperatures. It is to be noted that in the latex material shown in Table 2, the balance was water (64% by mass).

Nos. 2 to 4

Three films were obtained for Nos. 2 to 4 respectively, in a similar manner to No. 1 except that the latex materials shown in Table 2 were used.

TABLE 2

| | | No. 1 | No. 2 | No. 3 | No. 4 |
|---|---|---|---|---|---|
| Solid content rate (parts by mass) | NBR | 100 | 100 | 100 | 100 |
| | Zinc oxide | 0 | 0 | 2.5 | 2.5 |
| | Polycarbodiimide | 0 | 2 | 0 | 2 |
| Solid content in latex material (% by mass) | | 36 | 36 | 36 | 36 |
| Mass ratio of polycarbodiimide to NBR | | 0 | 0.02 | 0 | 0.02 |

Measurement of Tensile Strength

Tensile strength was measured on each of the films obtained, with a universal tester Autograph ("AGS-J" available from Shimadzu Corporation). The measurement was carried out on a test piece obtained from each of the films by using a JIS dumbbell cutter No. 3, under conditions involving a strain rate of 500 mm/min, a chuck interval of 60 mm, and a line interval of 20 mm. The results are shown in Table 3.

The results shown in Table 3 indicate that, in the films of No. 2 formed from the latex material containing the polycarbodiimide but not the zinc oxide, no improvement in tensile strength was observed compared to the films of No. 1 containing neither of the polycarbodiimide and the zinc oxide, regardless of the temperature for promoting the crosslinking reaction.

In the films of No. 3 formed from the latex material containing the zinc oxide but not the polycarbodiimide, an improvement in tensile strength was observed in the films in which the crosslinking reaction was promoted at a temperature no less than 80° C.; however, no improvement in tensile strength was observed in the film in which the crosslinking reaction was promoted at 40° C. In other words, it is proven that for the films of No. 3, the temperature no less than 80° C. was required for promotion of the crosslinking reaction.

Whereas, in the films of No. 4 formed from the latex material containing the polycarbodiimide and the zinc oxide, an improvement in tensile strength was observed regardless of the temperature for promoting the crosslinking reaction. In other words, it is proven that in the films of No. 4, promotion of the crosslinking reaction was possible at a temperature as low as 40° C.

From the foregoing, it is proven that, in the case of blending the polycarbodiimide or the zinc oxide individually, the temperature no less than 80° C. is required for promotion of the crosslinking reaction, whereas in the case of blending both the polycarbodiimide and the zinc oxide, promotion of the crosslinking reaction is possible at 40° C. In other words, the combination of the polycarbodiimide and the zinc oxide is considered to have promoted the crosslinking reaction and inhibited the generation of cracks.

INDUSTRIAL APPLICABILITY

As explained in the foregoing, in the glove according to the embodiment of the present invention, inhibition of the generation of cracks in the coating layer constituted with the nitrile butadiene rubber as a principal component is enabled. Therefore, the glove according to the present invention is superior in appearance, and also superior in durability, oil resistance and chemical resistance due to less likelihood of formation of a cleavage in the coating layer.

EXPLANATION OF THE REFERENCE NUMERALS

1 Glove main body
2 Coating layer

What is claimed is:

1. A glove comprising:

a glove main body made of fibers for covering a wearer's hand; and a coating layer which comprises nitrile butadiene rubber as a principal component and coats at least a part of an outer face of a palm region of the glove main body, wherein:

the glove main body is knitted with a glove knitting machine having a gauge of no less than 13 and no greater than 26;

the coating layer comprises zinc oxide, and a cross-linked product of the nitrile butadiene rubber and polycarbodiimide;

a mass ratio of the polycarbodiimide to the nitrile butadiene rubber is no less than 0.002 and no greater than 0.09;

a content of the zinc oxide with respect to 100 parts by mass of the nitrile butadiene rubber is no less than 1.0 parts by mass and no greater than 3.5 parts by mass a molar ratio of the zinc oxide to a carbodiimide group of the polycarbodiimide is no less than 1 and no greater than 50;

the cross-linked product comprises: a carboxyl group; a carbodiimide group; and a reaction-produced group from a carboxyl group and a carbodiimide group; and a molar ratio of a total of the carbodiimide group and the reaction-produced group to a total of the carboxyl group and the reaction-produced group is no less than 0.008 and no greater than 1.

* * * * *